US010347164B2

(12) United States Patent
Roh et al.

(10) Patent No.: US 10,347,164 B2
(45) Date of Patent: Jul. 9, 2019

(54) DATA COMPENSATOR AND DISPLAY DEVICE HAVING THE SAME

(71) Applicant: SAMSUNG DISPLAY CO., LTD., Yongin-si, Gyeonggi-Do (KR)

(72) Inventors: Seok Hwan Roh, Daejeon (KR); Byung-Hyun Kim, Hwaseong-si (KR); Ki-Won Shin, Hwaseong-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 128 days.

(21) Appl. No.: 15/487,038

(22) Filed: Apr. 13, 2017

(65) Prior Publication Data

US 2017/0309213 A1 Oct. 26, 2017

(30) Foreign Application Priority Data

Apr. 25, 2016 (KR) ..... 10-2016-0050156

(51) Int. Cl.
*G09G 3/20* (2006.01)

(52) U.S. Cl.
CPC ..... *G09G 3/2003* (2013.01); *G09G 3/2044* (2013.01); *G09G 3/2074* (2013.01); *G09G 3/2092* (2013.01); *G09G 2310/08* (2013.01); *G09G 2320/0242* (2013.01); *G09G 2320/0646* (2013.01); *G09G 2320/0666* (2013.01)

(58) Field of Classification Search
USPC ..... 345/596, 597, 601, 589
See application file for complete search history.

(56) References Cited

U.S. PATENT DOCUMENTS

2007/0091042 A1* 4/2007 Chung ..... G09G 3/3648 345/88
2008/0001869 A1* 1/2008 Chung ..... G09G 3/3648 345/87
2016/0284283 A1* 9/2016 Kurita ..... G09G 3/3413
2017/0140705 A1* 5/2017 Xu ..... G09G 3/2003
2017/0294160 A1* 10/2017 Ono ..... G09G 3/20

FOREIGN PATENT DOCUMENTS

KR 1020120089010 8/2012
KR 1020150102788 9/2015
KR 1020160092552 8/2016

* cited by examiner

*Primary Examiner* — Jennifer Mehmood
*Assistant Examiner* — Deeprose Subedi
(74) *Attorney, Agent, or Firm* — F. Chau & Associates, LLC

(57) ABSTRACT

A data compensator includes a voltage drop compensator configured to output a voltage drop compensation value based on input data of pixels included in a display panel, a color difference compensator configured to output a color difference compensation value to compensate for compensate the color difference of the pixels, a compensation data generator configured to generate a compensation value of the input data based on the voltage drop compensation value and the color difference compensation value, and to generate a compensation data by performing an operation on the input data and the compensation value, and a dithering block configured to generate output data by dithering the compensation data.

19 Claims, 8 Drawing Sheets

| | | | | | | | | |
|---|---|---|---|---|---|---|---|---|
| VR1 | VR2 | VR3 | ··· | | | | | |
| VR10 | VR11 | VR12 | ··· | | | | | |
| VR19 | VR20 | VR21 | ··· | | | | | |
| ⋮ | ⋮ | ⋮ | | | | | | |
| | | | | | | | | |
| | | | | | | | | |
| | | | | | | | | |
| | | | | | | | | |
| | | | | | | | | |
| | | | | | | | | |
| | | | | | | | | |
| | | | | | | | | |
| | | | | | | | | |
| | | | | | | | | |
| | | | | | | | | VRN |

| | | |
|---|---|---|
| CR1 | ··· | |
| ⋮ | | |
| | CRC | |
| | | |
| | | CRM |

DATA COMPENSATOR AND DISPLAY DEVICE HAVING THE SAME

CROSS-REFERENCE TO RELATED APPLICATION(S)

This application claims priority under 35 USC § 119 to Korean Patent Application No. 10-2016-0050156, filed on Apr. 25, 2016 in the Korean Intellectual Property Office (KIPO), the disclosure of which is incorporated by reference in its entirety herein.

BACKGROUND

1. Technical Field

Exemplary embodiments of the inventive concept relate to a data compensator and a display device having the same.

2. Discussion of Related Art

Flat panel display (FPD) devices are widely to display images in electronic devices because FPD devices are relatively lightweight and thin compared to cathode-ray tube (CRT) display devices. Examples of FPD devices include liquid crystal display (LCD) devices, field emission display (FED) devices, plasma display panel (PDP) devices, and organic light emitting display (OLED) devices. The OLED devices have been spotlighted as next-generation display devices because the OLED devices have a wide viewing angle, a rapid response speed, a thin thickness, and low power consumption.

Display quality of an OLED device may be improved by performing a dithering process on input data applied to the OLED device. However, display quality of the OLED device may degrade when a data conflict occurs during the dithering process.

SUMMARY

At least one exemplary embodiment of the inventive concept provides a data compensator capable of improving a voltage drop and a color difference of a display panel.

At least one exemplary embodiment of the inventive concept provides a display device capable of improving a voltage drop and a color difference of a display panel.

According to an exemplary embodiment of the inventive concept, a data compensator includes a first circuit (e.g., voltage drop compensator) configured to output a voltage drop compensation value based on input data of pixels included in a display panel, a second circuit (e.g., a color difference compensator) configured to output a color difference compensation value to compensate for a color difference of the pixels, a third circuit (e.g., a compensation data generator) configured to generate a compensation value of the input data based on the voltage drop compensation value and the color difference compensation value, and to generate compensation data by performing an operation on the input data and the compensation value, and a fourth circuit (e.g., a dithering block) configured to generate an output data by dithering the compensation data.

In an exemplary embodiment, the first circuit (e.g., the voltage drop compensator) includes a fifth circuit (e.g., a current ratio calculator) configured to divide the display panel into N voltage drop regions, where the N is an integer equal to or greater than 1, and to calculate a current ratio flowing through each of the voltage drop regions based on the input data provided to the pixels included in each of the voltage drop regions and a sixth circuit (e.g., a voltage drop compensation value calculator) configured to calculate the voltage drop compensation value based on a resistance coefficient of each of the voltage drop regions, the current ratio of each of the voltage drop regions, and a weighted value of each of the voltage drop regions.

In an exemplary embodiment, the fifth circuit (e.g., the current ratio calculator) outputs the current ratio by calculating a ratio of the input data provided to all pixels included in the display panel to the input data provided to the pixels included in each of the voltage drop regions.

In an exemplary embodiment, the fifth circuit (e.g., the current ratio calculator) calculates the current ratio by summing a current ratio of a red sub-pixel included in each of the pixels, a current ratio of a green sub-pixel included in each of the pixels, and a current ratio of a blue sub-pixel included in each of the pixels.

In an exemplary embodiment, the second circuit (e.g., the color difference compensator) includes a fifth circuit (e.g., a color difference compensation value calculator) configured to divide the display panel into M color regions, where the M is an integer equal to or greater than 1, and to calculate the color difference compensation value of each of the color regions and a memory device configured to store the color difference compensation value.

In an exemplary embodiment, the fifth circuit (e.g., color difference compensation value calculator) calculates the color difference compensation value based on a ratio of a predetermined reference brightness and a brightness of each of the color regions.

In an exemplary embodiment, the fifth circuit (e.g., color difference compensation value calculator) calculates the color difference compensation value based on a ratio of a predetermined reference color coordinate to a color coordinate of each of the color regions.

In an exemplary embodiment, the third circuit (e.g., the compensation data generator) includes a fifth circuit (e.g., compensation value calculator) configured to generate the compensation value of the input data based on the voltage drop compensation value and the color difference compensation value and a sixth circuit (e.g., a compensation data calculator) configured to generate the compensation data by performing an operation on the input data and the compensation value.

In an exemplary embodiment, the fifth circuit (e.g., the compensation value calculator) generates the compensation value of the input data by multiplying the voltage drop compensation value with the color difference compensation value.

According to an exemplary embodiment of the inventive concept, a display device includes a display panel including a plurality of pixels, a data compensator configured to compensate for a voltage drop and a color difference of input data provided to the pixels, a scan driver configured to provide a scan signal to the pixels, a data driver configured to provide a data signal to the pixels, and a timing controller configured to generate control signals that control the display panel, the data compensator, the scan driver, and the data driver.

In an exemplary embodiment, the data compensator includes a first circuit (e.g., a voltage drop compensator) configured to output a voltage drop compensation value of the pixels based on input data of pixels, a second circuit (e.g., a color difference compensator) configured to output a color difference compensation value to compensate for a color difference of the pixels, a third circuit (e.g., a compensation data generator) configured to generate a compensation value of the input data based on the voltage drop compensating value and the color difference compensating value and to generate compensation data by performing an operation on the input data and the compensation value, and a fourth circuit (e.g., a dithering block) configured to generate output data by dithering the compensation data.

In an exemplary embodiment, first circuit (e.g., the voltage drop compensator) includes a fifth circuit (e.g., a current ratio calculator) configured to divide the display panel into N voltage drop regions, where the N is an integer equal to or greater than 1, and to calculate a current ratio flowing through each of the voltage drop regions based on the input data provided to the pixels included in each of the voltage drop regions and a sixth circuit (e.g., a voltage drop compensation value calculator) configured to calculate the voltage drop compensation value based on a resistance coefficient of each of the voltage drop regions, the current ratio of each of the voltage drop regions, and a weighted value of each of the voltage drop regions.

In an exemplary embodiment, the fifth circuit (e.g., a current ratio calculator) outputs the current ratio by calculating a ratio of the input data provided to all pixels in the display panel to the input data provided to the pixels included in each of the voltage drop regions.

In an exemplary embodiment, the fifth circuit (e.g., current ratio calculator) calculates the current ratio by summing a current ratio of a red sub-pixel included in each of the pixels, a current ratio of a green sub-pixel included in each of the pixels, and a current ratio of a blue sub-pixel included in each of the pixels.

In an exemplary embodiment, the second circuit (e.g., the color difference compensator) includes a fifth circuit (e.g., a color difference compensating value calculator) configured to divide the display panel into M color regions, where the M is an integer equal to or greater than 1, and to calculate the color difference compensation value of each of the color regions and a memory device (e.g., a color difference compensation value store block) configured to store the color difference compensation value.

In an exemplary embodiment, the fifth circuit (e.g., a color difference compensation value calculator) calculates the color difference compensation value based on a ratio of a predetermined reference brightness to a brightness of each of the color regions.

In an exemplary embodiment, the fifth circuit (e.g., the color difference compensation value calculator) calculates the color difference compensation value based on a ratio of predetermined reference color coordinate to a color coordinate of each of the color regions.

In an exemplary embodiment, the third circuit (e.g., the compensation data generator) includes a fifth circuit (e.g., a compensation value calculator) configured to generate a compensation value of the input data based on the voltage drop compensating value and the color difference compensating value and a sixth circuit (e.g., a compensation data calculator) configured to generate a compensation data by performing an operation on the input data and the compensation value.

In an exemplary embodiment, the fifth circuit (e.g., the compensation value calculator) generates the compensation value of the input data by multiplying the voltage drop compensation value with the color difference compensation value.

In an exemplary embodiment, the data compensator is coupled to the timing controller or located within the timing controller.

According to an exemplary embodiment of the inventive concept, a display driving apparatus for driving a display panel includes a first circuit configured to generate compensation data based on a first value used to compensate for a voltage drop of a first pixel of the display panel and a second value used to compensate for a color difference between the first pixel and second pixel of the display panel; a second circuit configured to perform dithering on the compensation data to generate dithered data; and a data driver configured to generate pixel data from the dithered data for output to the display panel.

In an exemplary embodiment, the voltage drop is a first voltage when the first pixel is a first distance from the data driver, the voltage drop is a second voltage when the second pixel is a second distance from the data driver, the first second voltage is greater than the first voltage, and the second distance is greater than the first distance.

In an exemplary embodiment, the first value is derived from a first number of bits of input data, the compensation data has a second number of bits more than the first number, and the dithered data has the first number of bits.

Therefore, a data compensator and a display device may perform a dithering process once by calculating a compensation value of an input data DI based on a voltage drop compensation value and a color difference compensation value. Thus, an over compensation of the input data in the dithering process may be prevented. Therefore, display quality may improve.

BRIEF DESCRIPTION OF THE DRAWINGS

Exemplary embodiments of the inventive concept will be more clearly understood from the following detailed description taken in conjunction with the accompanying drawings.

DETAILED DESCRIPTION OF THE EXEMPLARY EMBODIMENTS

Hereinafter, the present inventive concept will be explained in detail with reference to the accompanying drawings.

Figure 1:
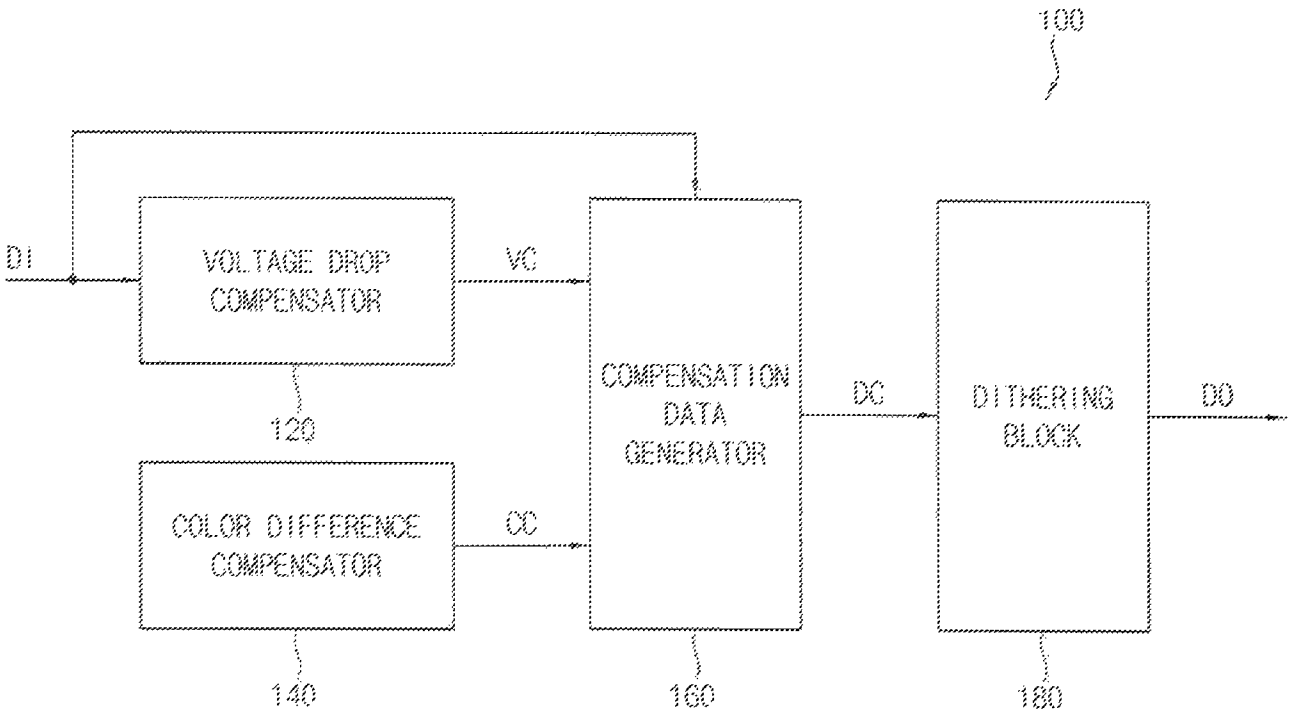
FIG. 1 is a block diagram illustrating a data compensator according to an exemplary embodiment of the inventive concept.

FIG. 1 is a block diagram illustrating a data compensator according to an exemplary embodiment of the inventive concept.

Referring to FIG. 1, a data compensator 100 include a voltage drop compensator 120, a color difference compensator 140, a compensation data generator 160, and a dithering block 180. In an embodiment, the voltage drop compensator 120, the color difference compensator 140, and the dithering block 180 are each implemented by a respective circuit or processor.

The voltage drop compensator 120 calculates a voltage drop compensation value VC based on input data DI for pixels included in a display panel and outputs the voltage drop compensation value VC. The voltage drop compensator 120 calculates the voltage drop compensation value VC that compensates for a voltage drop of the pixels included in the display panel. The voltage drop may occur according to a location of the pixels in the display panel. In an embodiment, an amount of the voltage drop increases as the distance between the pixel and an input block from which input data DI for the pixel is provided increases. For example, the input block may be a data driver (e.g., a data driving circuit). The voltage drop compensator 120 may generate the voltage drop compensation value VC having different values according to the location of the pixel.

In an embodiment, the voltage drop compensator 120 receives address information indicating the location of the pixel. For example, the address information could indicate a particular row and column that the pixel is located within. The address information may be received from a timing controller as an example. In an embodiment, the voltage drop compensator 120 receives a distance indicating a distance between the input block and the pixel. In an embodiment, the voltage drop compensator 120 stores a table including a plurality of entries, where each entry indicates one of the locations or the distances and a corresponding voltage drop compensation voltage. In this embodiment, the voltage drop compensator 120 uses the address information or location information to select a corresponding one of the entries to retrieve the corresponding voltage drop compensation voltage for application to the compensation data generator 160.

In an embodiment, the voltage drop compensator 120 includes a current ratio calculator and a compensation value calculator. In an embodiment, each of the calculators is implemented by a respective circuit or processor. The current ratio calculator divides the display panel into N voltage drop regions, where the N is an integer equal to or greater than 1, and calculates a current ratio flowing through each of the voltage drop regions based on the input data DI provided to the pixels included in each of the voltage drop regions. In an embodiment, the current ratio calculator outputs the current ratio by calculating a ratio of the input data DI provided to all pixels included in the display panel to the input data DI provided to the pixels included in each of the voltage drop regions. In an embodiment, the current ratio calculator calculates the current ratio by summing a current ratio of a red sub-pixel included in each of the pixels, a current ratio of a green sub-pixel included in each of the pixels, and a current ratio of a blue sub-pixel included in each of the pixels. In an embodiment, the compensation value calculator calculates the voltage drop compensation value VC based on a resistance coefficient of each of the voltage drop regions, a weighted value of each of the voltage drop regions, and the current ratio of each of the voltage drop regions. Here, the resistance coefficient may be a resistance coefficient of a line (e.g., a wire) through which the input data DI is provided. Further, the weighted value may be proportional to the distance between the pixel and the input block (e.g., data driver).

In an embodiment, the color difference compensator 140 stores a color difference compensation value CC to compensate for the color difference of the pixels and outputs the color difference compensation value CC. The color difference compensator 140 may include a color difference compensation value calculator and a color difference compensation value store block. In an embodiment, the color difference compensation value calculator and the color difference compensation value store block are each implemented by a circuit or processor. The color difference compensation value calculator divides the display panel into M color regions, where the M is an integer equal to or greater than 1, and calculates the color difference compensation value CC of each of the color regions. For example, the color difference compensation value CC could be calculated in a factory that manufactures a display device that uses the data compensator before shipment of the display device. In an exemplary embodiment, the color difference compensation value calculator calculates the color difference compensation value CC based on a ratio of a predetermined reference brightness and a brightness of each of the color regions. In an embodiment, the color difference compensation value calculator displays an image having a predetermined grayscale value (e.g., 64 grayscale) on the display panel and measures the brightness of each of the color regions. For example, the color different compensation value calculator could measure the brightness of each color region in the factory before shipment. In an embodiment, the reference brightness is the brightness of the color region located in the center of the display panel. In an alternate embodiment, the reference brightness is the average brightness of the color regions. In an embodiment, the color difference compensation value calculator calculates the ratio of the reference brightness to the brightness of the color regions. In an exemplary embodiment, the color difference compensation value calculator calculates the color difference compensation value CC based on a ratio of a predetermined reference color coordinate and a color coordinate of the color regions. In an embodiment, the color difference compensation value calculator displays an image having a predetermined grayscale value (e.g., 64 grayscale) on the display panel and measures the color coordinate of each of the color regions. In an embodiment, the color difference compensation value calculator measures the color coordinate of each of the color regions in the factory before shipment. In an embodiment, the reference color coordinate is a color coordinate of the color region located in the center of the display panel. In an alternate embodiment, the reference color coordinate is the average color coordinate of the color regions. In an embodiment, the color difference compensation value calculator calculates the ratio of the reference color coordinate to the color coordinate of the color regions. Specifically, the color coordinate may include x-coordinate (e.g. Wx) and y-coordinate (e.g. Wy). The color difference compensation value calculator may respectively calculate the ratio of the x-coordinate of the reference color coordinate to the x-coordinate of the color coordinate of the color regions and the ratio of the y-coordinate of the reference color coordinate to the y-coordinate of the color coordinate of the color regions. The color difference compensation value store block may store the color difference compensation value CC. For example, the color difference compensation value store block may be implemented as a lookup table (LUT) that stores the color difference compensation value CC corresponding to the color regions. In an embodiment, the color difference compensation value store block includes a memory device to store the color difference compensation value CC or the LUT.

In an embodiment, the compensation data generator 160 generates a compensation value of the input data DI based on the voltage drop compensation value VC and the color difference compensation value CC and generates the compensation data DC by performing an operation on the input data DI and the compensation value. The compensation data generator 160 may include a compensation value calculator and a compensation data calculator. In an embodiment, the compensation value calculator generates the compensation value of the input data DI based on the voltage drop compensation value VC provided from the voltage drop compensator 120 and the color difference compensation value CC provided from the color difference compensator 140. The compensation value calculator may generate the compensation value by multiplying the voltage drop compensation value VC with the color difference compensation value CC. In embodiment, the compensation value calculator includes a multiplier to perform the multiplying. In an exemplary embodiment, the compensation data generator 160 generates the compensation data DC by summing the compensation value and the input data DI. In an exemplary embodiment, the compensation data generator 160 generates the compensation data DC by multiplying the compensation value with the input data DI. For example, the compensation data generator 160 may alternate between outputting the compensation value VC and the input data DI as the compensation data DC. In embodiment, the compensation data generator 160 includes a multiplier to perform the multiplying.

In an embodiment, the dithering block 180 generates output data DO by dithering the compensation data DC. For example, the dithering block 180 may perform a dithering operation on the compensation data DC. In an embodiment, the input data DI has Kbit data and the compensation data DC has more than Kbit data. For example, the input data DI may be a data having 10 bits and the compensation data DC may have 13 bits. In an embodiment, the dithering block 180 corrects the compensation data DC having more than Kbit data into output data DO having the same number of bits as the input data DI (that is, Kbit).

As described above, in an exemplary embodiment, the data compensator 100 generates the compensation value of the input data DI based on the voltage drop compensation value VC of the input data DI provided to the pixels and the color difference compensation value CC of the input data DI provided to the pixels, generates the compensation data DC by performing an operation on the input data DI and the compensation data DC, and dithers the compensation data DC. Thus, a high quality image may be displayed on the display panel. When a voltage drop compensation and a color difference compensation are respectively performed, the dithering of the data of which a voltage drop is compensated and the dithering of the data of which a color difference is compensated may be respectively performed. In this case, the data may be over compensated and the image may be distorted. The data compensator 100 of FIG. 1 calculates the compensation value of the input data DI that compensates the voltage drop and the color difference, and performs a dithering process once. Thus, an over compensation that would otherwise occur in the dithering process may be prevented.

Figures 2, 3:
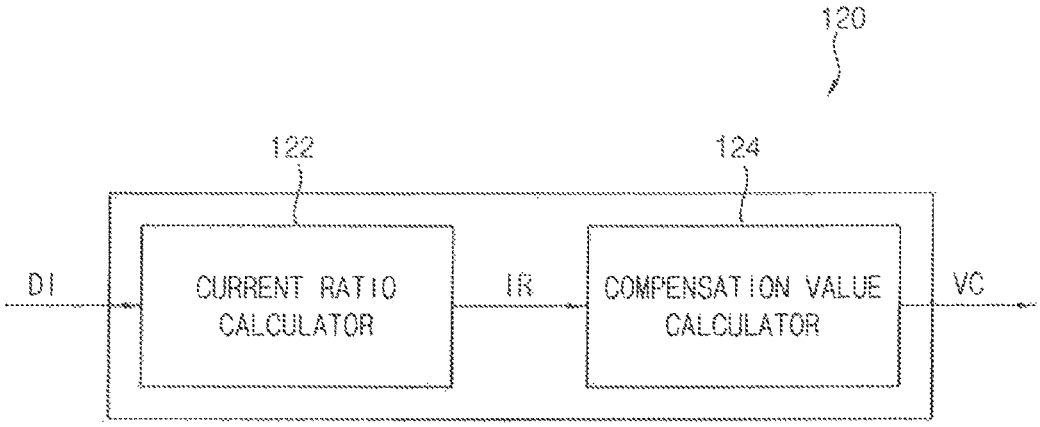
FIG. 2 is a diagram illustrating a voltage drop compensator included in the data compensator of FIG. 1.
FIG. 3 is a diagram illustrating for describing an operation of the voltage drop compensator of FIG. 2.

FIG. 2 is a diagram illustrating a voltage drop compensator included in the data compensator of FIG. 1 and FIG. 3 is a diagram illustrating for describing an operation of the voltage drop compensator of FIG. 2.

Referring to FIG. 2, a voltage drop compensator 120 of the data compensator 100 includes a current ratio calculator 122 and a compensation value calculator 124.

Referring to FIG. 3, the current ratio calculator 122 divides the display panel into N voltage drop regions VR1, VR2, . . . , VRN. The current ratio calculator 122 calculates a current ratio IR flowing through each of the voltage drop regions VR1, VR2, . . . , VRN based on the input data DI of the pixels included in each of the voltage drop regions VR1, VR2, . . . , VRN. For example, the current ratio IR of the first voltage drop region VR1 may be calculated based on the ratio of the input data DI provided to all pixels to the input data provided to the pixels in the first voltage drop region VR1. The current ratio calculator 122 may calculate the current ratio of the first through Nth voltage drop regions VR1, VR2, . . . , VRN using this method.

Each of the pixels may include a red sub-pixel, a green sub-pixel, and a blue sub-pixel. A red input data may be provided to the red sub-pixel, a green input data may be provided to the green sub-pixel, and a blue input data may be provided to the blue sub-pixel. The current ratio calculator 122 may calculate the current ratio IR of each of the voltage drop regions based on the red input data, the green input data, and the blue input data. For example, the current ratio calculator 122 may calculate a ratio of the red input data provided to the all red sub-pixels to the red input data provided to the first voltage drop region VR1, a ratio of the green input data provided to the all green sub-pixels to the green input data provided to the first voltage drop region VR1, and a ratio of the blue input data provided to the all blue sub-pixels to the blue input data provided to the first voltage drop region VR1. The current ratio calculator 122 may calculate the current ratio of the first voltage drop region VR1 by summing the ratio of the red sub-pixel, the ratio of the green sub-pixel, and the ratio of the blue sub-pixel.

The compensation value calculator 124 may calculate the voltage drop compensation value VC based on a resistor coefficient of each of the voltage drop regions, the current ratio of each of the voltage drop regions, and a weighted value of each of the voltage drop regions. That is, the compensation value calculator may calculate the voltage drop compensation value VC of each of the regions based on Equation 1 as follows:

$$VC_N = Rt \times \Sigma\Sigma I_N \times T_N \quad \text{[Equation 1]}$$

where $VC_N$ is the voltage drop compensation value VC of the Nth voltage drop region, Rt is the resistance coefficient, $I_N$ is the current ratio IR of the Nth voltage drop region, and $T_N$ is the weighted value of the Nth voltage drop region.

The resistance coefficient may be a resistance coefficient of lines (e.g., wires) through which the data is provided to the pixels. The weighted value may be proportional to the distance between the pixel and input block from which the input data DI is provided. Here, the input block may be a data driver. For example, when the input block from which the input data DI is located on the left side of the display panel, the weighted value of the voltage drop region located on the right side of the display panel may be greater than the voltage drop region located on the left side of the display panel. The current ratio of the Nth voltage drop region may be the sum of the current ratio of the red sub-pixel of the Nth voltage drop region, the current ratio of the green sub-pixel of the Nth voltage drop region, and the current ratio of the blue sub-pixel of the Nth voltage drop region.

Figures 4, 5:
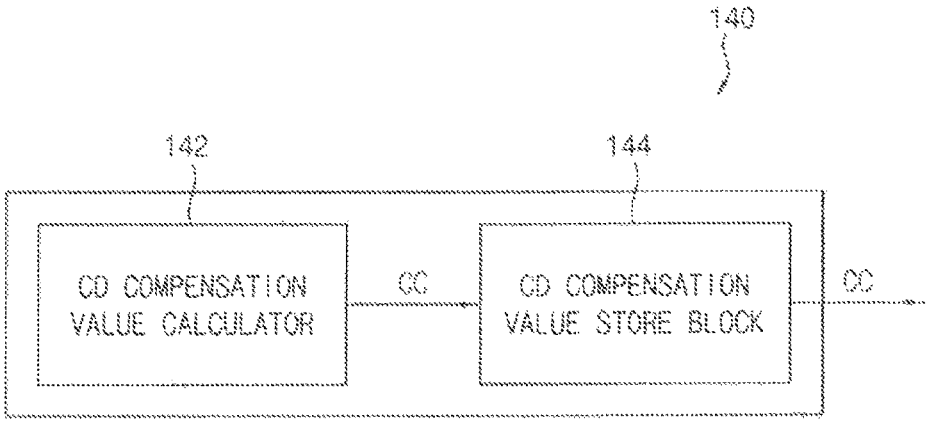
FIG. 4 is a block diagram illustrating a color difference compensator included in the data compensator of FIG. 1.
FIG. 5 is a diagram illustrating for describing an operation of the color difference compensator of FIG. 4.

FIG. 4 is a block diagram illustrating a color difference compensator included in the data compensator of FIG. 1 and FIG. 5 is a diagram illustrating for describing an operation of the color difference compensator of FIG. 4.

Referring to FIG. 4, the color difference compensator 140 includes the color difference compensation value calculator 142 and the color difference compensation value store block 144. In an embodiment, the compensation value calculator 142 and the color difference compensation value store block 144 are each implemented by a circuit.

Referring to FIG. 5, the color difference compensation value calculator 142 divides the display panel into M color regions CR1, . . . , CRM and calculates the color difference compensation value CC. In an embodiment, the color difference (CD) compensation value calculator 142 calculates the color difference compensation value CC in the factory before shipment. In an exemplary embodiment, the color difference compensation value calculator 142 calculates the color difference compensation value CC based on a ratio of a predetermined reference brightness and brightness of the color regions. In an embodiment, the color difference compensation value calculator 142 displays an image having predetermined grayscale value (e.g., 16 grayscale) on the display panel and measures the brightness of each of the color regions using a measuring device such as a camera, a brightness meter, etc. In an embodiment, the reference brightness is the brightness of the color region CRC located in the center of the display panel. In an alternate embodiment, the reference brightness is the average brightness of the color regions CR1, . . . , CRM. In an embodiment, the color difference compensation value calculator 142 calculates the brightness ratio of the reference brightness to the brightness of each of the color regions. For example, the brightness ratio of the first color region CR1 may be the ratio of the reference brightness to the brightness of the first color region CR1. In an embodiment, the color difference (CD) compensation value store block 144 stores the brightness ratio provided from the color difference compensation value calculator 142 as the color difference compensation value CC. In an embodiment, the color difference compensation value calculator 142 displays an image having a predetermined grayscale value (e.g., 255 grayscale) on the display panel and measures the color coordinate of each of the color regions using a measuring device such as a camera, a color coordinate meter, etc. In an embodiment, the reference color coordinate is the color coordinate of the color region CRC located in the center of the display panel. In an alternate embodiment, the reference color coordinate is the average color coordinate of the color regions CR1, . . . , CRM. In an embodiment, the color difference compensation value calculator 142 calculates the ratio of the reference color coordinate to the color coordinate of each of the color regions. For example, the color coordinate ratio of the first color region may be calculated as the ratio of the reference color difference to the color coordinate of the first color region. In an embodiment, the color difference compensation value store block 144 stores the color coordinate ratio provided from the color difference compensation calculator 142 as the color difference compensation value CC.

Figure 6:
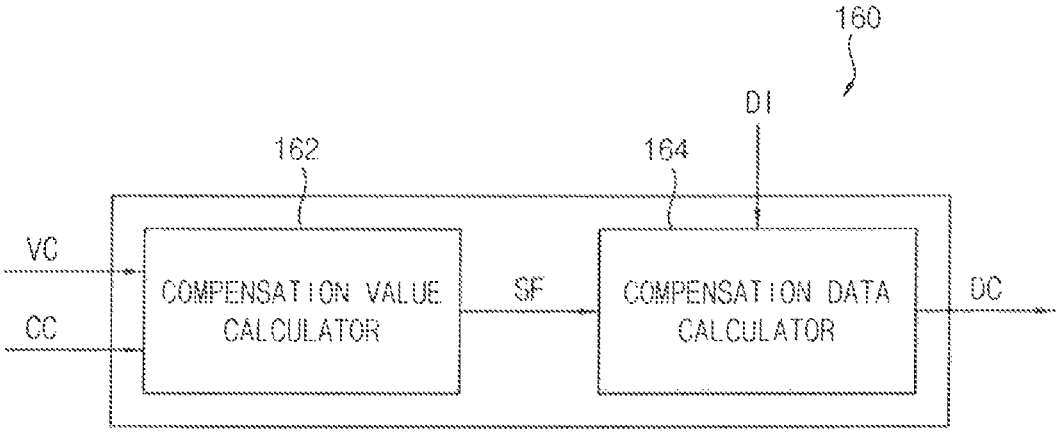
FIG. 6 is block diagram illustrating a compensation data generator included in the data compensator of FIG. 1.
Figure 7:
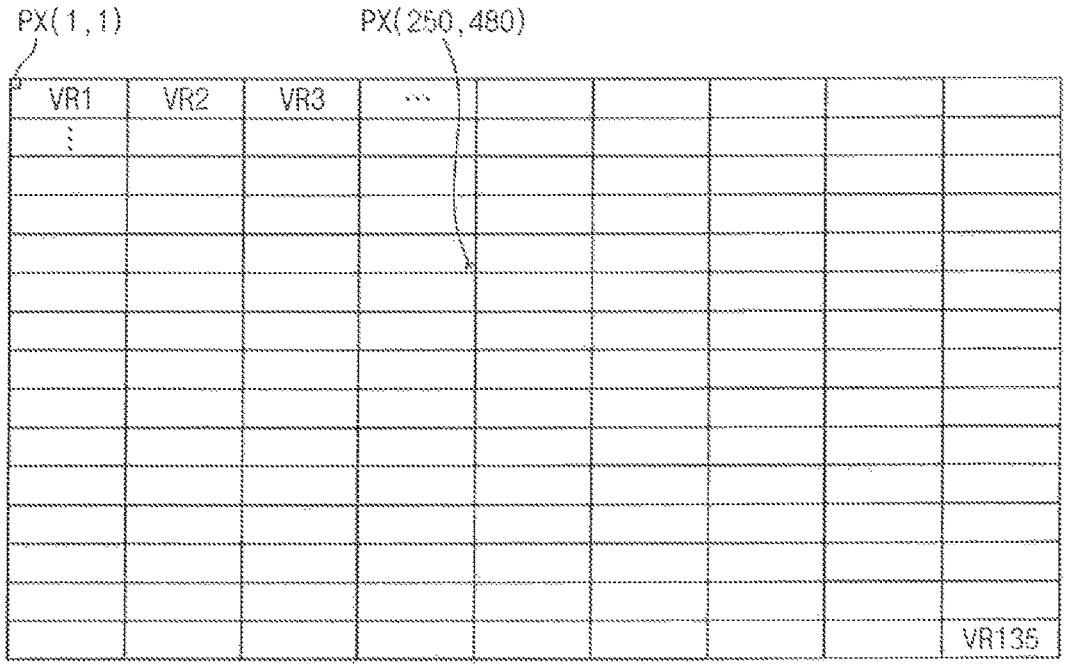
FIG. 7 is a diagram illustrating for describing an operation of the compensation data generator of FIG. 6.
Figure 7:
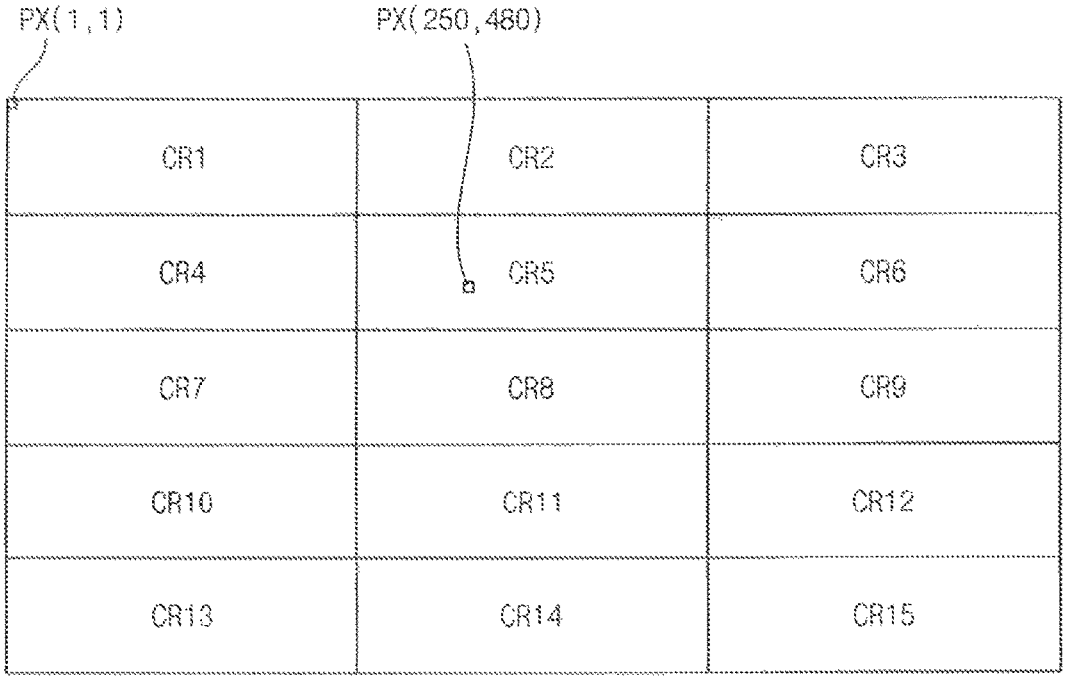

FIG. 6 is block diagram illustrating a compensation data generator included in the data compensator of FIG. 1 and FIG. 7 is a diagram illustrating for describing an operation of the compensation data generator of FIG. 6.

Referring to FIG. 6, the compensation data generator 160 may include a compensation value calculator 162 and a compensation data calculator 164.

Referring to FIG. 7, the voltage drop compensator 120 divides the display panel into N voltage drop regions VR1, . . . , VR135. The color difference compensator 140 divides the display panel into M color regions CR1, . . . , CR15. The number of the pixels included in the voltage drop region and the number of the pixels included in the color region may be different from each other. For example, when the display panel includes 750*1080 pixels, the voltage drop compensator 120 may divide the display panel into 9*15 voltage drop regions VR1, . . . , VR 135, and the color difference compensator 140 may divide the display panel into 3*5 color regions CR1, . . . , CR15 as depicted in FIG. 7. For example, 50*120 pixels may be included in one voltage drop region VR and 150*360 pixels may be included in one color region CR. The compensation value calculator 162 receives the voltage drop compensation value VC from the voltage drop compensator 120 and the color difference compensation value CC from the color difference compensator 140. For example, the compensation value calculator 162 may receive the voltage drop compensation value VC of the first voltage drop region VR1 and the color difference compensation value CC of the first color region CR1 in order to calculate a compensation value SF of the input data provided to a pixel PX(1,1) located in the 1st column and the 1st row. For example, the compensation value calculator 162 may receive the voltage drop compensation value VC of the 40th voltage drop region VR40 and the color difference compensation value CC of the fifth color region CR5 in order to calculate a compensation value SF of the input data provided to a pixel PX(250, 480) located in the 250th column and the 480th row. The compensation value calculator 162 may generate the compensation value SF of the input data DI by multiplying the voltage drop compensation value VC provided from the voltage drop compensator 120 with the color difference compensation value CC provided from the color difference compensator 140. That is, the compensation value calculator 162 may generate the compensation value SF of the input data DI based on Equation 2 as follows.

$$SF(x,y)=Rt\times\Sigma\Sigma I_N\times T_N(x,y)\times\Sigma Y_M \quad \text{[Equation 2]}$$

where SF(x, y) is the compensation value of the input data DI provided to the pixel at location (x, y), Rt is the resistance coefficient, $I_N$ is the current ratio of the Nth voltage drop region, $T_N$ is the weighted value of the Nth voltage drop region, and $Y_M$ is the brightness ratio of the Mth color region.

In an embodiment, the compensation data calculator 164 generates the compensation data DC by performing an operation on the input data DI and the compensation value SF of the input data. In an exemplary embodiment, the compensation data calculator 164 generate the compensation data DC by summing the compensation value SF of the input data DI and the input data DI of the pixel. For example, the compensation data calculator 164 may include an adder or adder circuit to sum the compensation value SF and the input data DI. In an exemplary embodiment, the compensation data calculator 164 generates the compensation data DC by multiplying the input data DI of the pixel with the compensation value SF of the input data DI. For example, the compensation data calculator 164 can alternate between outputting the compensation value SF and the input data DI as the compensation data DC.

Figure 8:
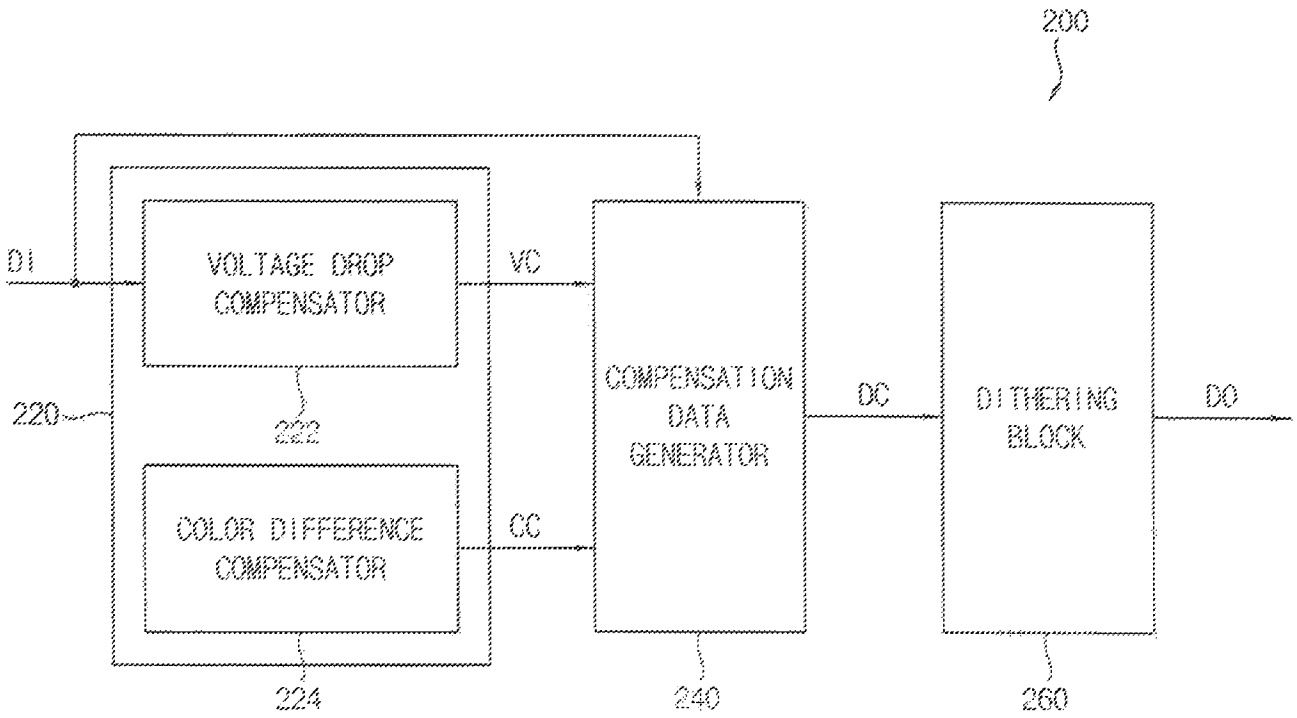
FIG. 8 is a block diagram illustrating a data compensator according to an exemplary embodiment of the inventive concept.

FIG. 8 is a block diagram illustrating a data compensator according to an exemplary embodiment of the inventive concept.

Referring to FIG. 8, the data compensator 200 includes a compensation output block 220, a compensation data generator 240, and a dithering block 260. The data compensator 200 has the same structure as the data compensator 100 of FIG. 1 except that the voltage drop compensator 222 and the color difference compensator 224 are implemented as one block (that is, the compensation output block 220).

Figure 9:
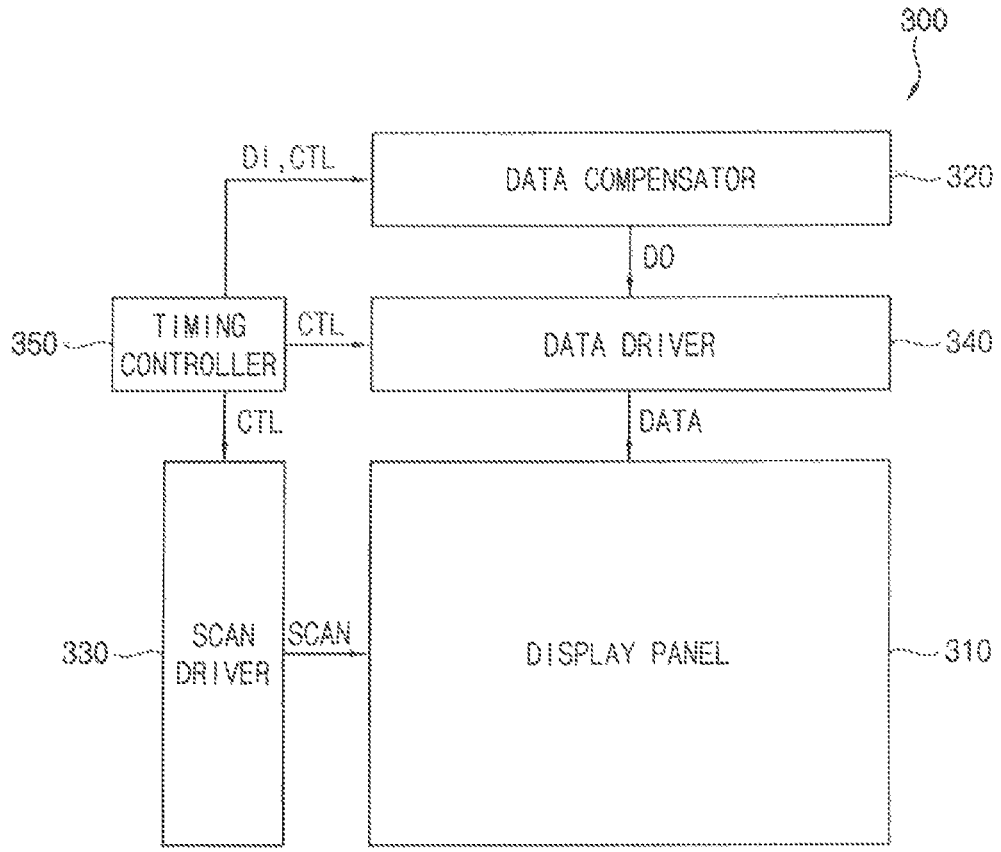
FIG. 9 is a block diagram illustrating a display device according to an exemplary embodiment of the inventive concept.

FIG. 9 is a block diagram illustrating a display device according to an exemplary embodiment of the inventive concept.

Referring to FIG. 9, a display device 300 includes a display panel 310, a data compensator 320, a scan driver 330, a data driver 340, and a timing controller 350.

The display panel 310 may include a plurality of pixels. A plurality of data lines and a plurality of scan lines are disposed on the display panel 310. The plurality of pixels may be interposed between the data lines and the scan lines. In an exemplary embodiment, each of the pixels includes a pixel circuit, a driving transistor, and an organic light emitting diode. In this embodiment, the pixel circuit provides a data signal DATA provided through the data line to the driving transistor in response to a scan signal SCAN provided through the scan line. The driving transistor may control a driving current flowing through the organic light emitting diode based on the data signal DATA. The organic light emitting diode may emit light based on the driving current.

In an embodiment, the data compensator 320 compensates for a voltage drop and a color difference of an input data DI provided to the pixels. The data compensator 320 may include a voltage drop compensator, a color difference compensator, a compensation data generator, and a dithering block. The voltage drop compensator may calculate a voltage drop compensation value based on the input data DI of the pixels and output a voltage drop compensation value. The voltage drop compensator may divide the display panel 310 into N voltage drop regions and calculate the voltage drop compensation value of each of the voltage drop regions based on the input data DI provided to each of the voltage drop regions. The color difference compensator may store the color difference compensation value for compensating the color difference of the pixels and output the color difference compensation value. The color difference compensator may divide the display panel 310 into M color regions and may store the color difference compensation value of each of the color regions in the factory before shipment. In an exemplary embodiment, the color difference compensator calculates the color difference compensation value based on a ratio of a predetermined reference brightness to the brightness of the color region. In an alternate embodiment, the color difference compensator calculates the color difference compensation value based on a ratio of a predetermined reference color coordinate to the color coordinate of the color region. The compensation data generator may generate a compensation value of the input data DI based on the voltage drop compensation value and the color difference compensation value, and generate the compensation value by performing an operation on the input data DI and the compensation value. In an embodiment, the compensation data generator generates the compensation value of the input data DI by multiplying the voltage drop compensation value with the color difference compensation value, and generates the compensation data by summing the input data DI and the compensation value or multiplying the input data with the compensation value.

The scan driver 330 may provide the scan signal SCAN to the pixels through the plurality of scan lines. The data driver 340 may generate the data signal DATA by converting the output data DO provided from the data compensator 320. The data driver 340 may provide the data signal DATA to the pixels through the data lines in response to the scan signal SCAN.

The timing controller 350 may provide the input data DI to the data compensator 320. Further, the timing controller 350 may generate the control signals CTL that controls the data compensator 320, the scan driver 330, and the data driver 340, and provide the control signals CTL to each of the data compensator 320, the scan driver 330, and the data driver 340.

The data compensator 320 may be coupled to the timing controller 350 as described in FIG. 9. Alternatively, the data compensator 320 may be located in the timing controller 350. The data compensator 320 may be coupled to the data driver 340 or be located in the data driver 340.

As described above, the data compensator 320 included in the display device 300 may generate the compensation value of the input data based on the voltage drop compensation value and the color difference compensation value, generate the compensation data by calculating the input data DI and the compensation value, and dither the compensation data. When the voltage drop compensation and the color difference compensation are respectively performed, the dithering may be respectively performed. In this case, the data may be over compensated and the image may be distorted. The data compensator 320 of the display device of FIG. 9 may perform the dithering process once by calculating the compensation value of the input data DI based on the voltage drop compensation value and the color difference compensation value. Thus, the over compensation of the data in the dithering process may be prevented. Therefore, display quality may improve.

Figure 10:
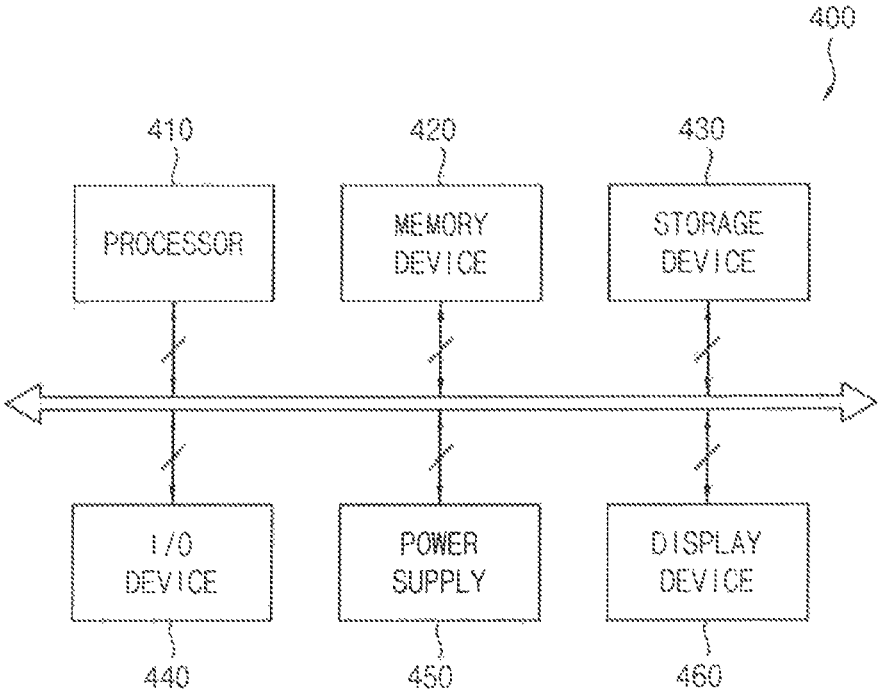
FIG. 10 is a block diagram illustrating an electronic device that includes the display device of FIG. 9.
Figure 11:
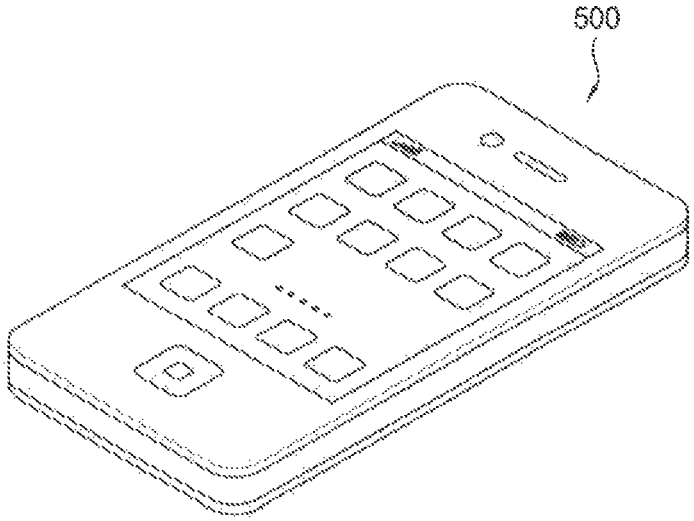
FIG. 11 is a diagram illustrating an exemplary embodiment in which the electronic device of FIG. 10 is implemented as a smart phone.

FIG. 10 is a block diagram illustrating an electronic device that includes the display device of FIG. 9 and FIG. 11 is a diagram illustrating an exemplary embodiment in which the electronic device of FIG. 10 is implemented as a smart phone.

Referring to FIGS. 10 and 11, an electronic device 400 includes a processor 410, a memory device 420, a storage device 430, an input/output (I/O) device 440, a power device 450, and a display device 460. Here, the display device 460 may correspond to the display device 300 of FIG. 9. In addition, the electronic device 400 may further include a plurality of ports for communicating with a video card, a sound card, a memory card, a universal serial bus (USB) device, or other electronic device, etc. Although it is illustrated in FIG. 11 that the electronic device 400 is implemented as a smart phone 500, the type of the electronic device 400 is not limited thereto.

The processor 410 may perform various computing functions. The processor 410 may be a micro processor, a central processing unit (CPU), etc. The processor 410 may be coupled to other components via an address bus, a control bus, a data bus, etc. Further, the processor 410 may be coupled to an extended bus such as a peripheral component interconnect (PCI) bus. The memory device 420 may store data for operations of the electronic device 400. For example, the memory device 420 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile DRAM device, etc. The storage device 430 may be a solid stage drive (SSD) device, a hard disk drive (HDD) device, a CD-ROM device, etc.

The I/O device 440 may be an input device such as a keyboard, a keypad, a touchpad, a touch-screen, a mouse, etc, and an output device such as a printer, a speaker, etc. In an exemplary embodiment, the display device 460 is included within the I/O device 440. The power device 450 may provide a power for operations of the electronic device 400. The display device 460 may communicate with other components via the buses or other communication links. As described above, the display device 460 may include a display panel, a data compensator, a scan driver, a data driver, and a timing controller. The display panel may include a plurality of pixels. The data driver may compensate for a voltage drop and a color difference of an input data provided to the pixels. The data compensator may include a voltage drop compensator, a color difference compensator, a compensation data generator, and a dithering block. The voltage drop compensator may divide the display panel into N voltage drop regions, and calculate the voltage drop compensation value based on the input data provided to the pixels in each of the voltage regions. The color difference compensator may divide the display panel into M color regions and store the color compensation value of each of the color regions in the factory before shipment. The compensation data generator may generate the compensation value of the input data based on the voltage drop compensation value and the color difference compensation value and generate the compensation data by calculating the input data and the compensation value. The dithering block may generate an output data by dithering the compensation data provided from the compensation data generator. The data driver may generate the data signal by converting the output data provided from the data compensator. The scan driver may provide the scan signal to the pixels through the scan lines and the data driver may provide the data signal to the pixels through the data lines in response to the scan signal. The timing controller may generate control signals that control the data compensator, the scan driver, and the data driver and provide the control signals to the data compensator, the scan driver, and the data driver.

As described above, the electronic device 400 may include the display device 460 having the data compensator. The data compensator of the display device 460 may perform the dithering process once by calculating the compensation value of the input data DI based on the voltage drop compensation value and the color difference compensation value. Thus, over compensation of the data in the dithering process may be prevented. Therefore, display quality of the display device 460 may improve.

The present inventive concept may be applied to a display device and an electronic device having the display device. For example, the present inventive concept may be applied to a computer monitor, a laptop, a digital camera, a cellular phone, a smart phone, a smart pad, a television, a personal digital assistant (PDA), a portable multimedia player (PMP), a MP3 player, a navigation system, a game console, a video phone, etc.

Although a few exemplary embodiments of the inventive concept have been described above, those skilled in the art will readily appreciate that many modifications are possible in the example embodiments without materially departing from the teachings of the present inventive concept. Accordingly, all such modifications are intended to be included within the scope of the present inventive concept.

What is claimed is:

1. A data compensator comprising:

a first circuit configured to output a voltage drop compensation value based on input data of a plurality of pixels included in a display panel;

a second circuit configured to output a color difference compensation value to compensate for a color difference of the plurality of pixels;

a third circuit configured to generate a compensation value of the input data by multiplying the voltage drop compensation value with the color difference compensation value, and to generate compensation data by performing an operation on the input data and the compensation value; and a fourth circuit configured to generate output data by dithering the compensation data.

2. The data compensator of claim 1, wherein the first circuit comprises:

a fifth circuit configured to divide the display panel into N voltage drop regions, where the N is an integer equal to or greater than 1, and to calculate a current ratio flowing through each of the voltage drop regions based on the input data provided to the pixels included in each of the voltage drop regions; and a sixth circuit configured to calculate the voltage drop compensation value based on a resistance coefficient of each of the voltage drop regions, the current ratio of each of the voltage drop regions, and a weighted value of each of the voltage drop regions.

3. The data compensator of claim 2, wherein the fifth circuit outputs the current ratio by calculating a ratio of the input data provided to all pixels included in the display panel to the input data provided to the pixels included in each of the voltage drop regions.

4. The data compensator of claim 2, wherein the fifth circuit calculates the current ratio by summing a current ratio of a red sub-pixel included in each of the pixels, a current ratio of a green sub-pixel included in each of the pixels, and a current ratio of a blue sub-pixel included in each of the pixels.

5. The data compensator of claim 1, wherein the second circuit comprises:

a fifth circuit configured to divide the display panel into M color regions, where the M is an integer equal to or greater than 1, and to calculate the color difference compensation value of each of the color regions; and a memory device configured to store the color difference compensation value.

6. The data compensator of claim 5, wherein the fifth circuit calculates the color difference compensation value based on a ratio of a predetermined reference brightness to a brightness of each of the color regions.

7. The data compensator of claim 5, wherein the fifth circuit calculates the color difference compensation value based on a ratio of a predetermined reference color coordinate to a color coordinate of each of the color regions.

8. The data compensator of claim 1, wherein the third circuit comprises:

a fifth circuit configured to perform the multiplying; and a sixth circuit configured to generate the compensation data by performing an operation on the input data and the compensation value.

9. A display device comprising:

the display panel including the plurality of pixels;

the data compensator of claim 1;

a scan driver configured to provide a scan signal to the pixels;

a data driver configured to provide a data signal to the pixels; and a timing controller configured to generate control signals that control the display panel, the data compensator, the scan driver, and the data driver.

10. A data compensator comprising:

a first circuit configured to output a voltage drop compensation value based on input data of a plurality of pixels included in a display panel comprising a plurality of color regions;

a second circuit configured to output a color difference compensation value to compensate for a color difference of the pixels, the color difference compensation value generated from a ratio of a predetermined reference color coordinate to a color coordinate of each of the color regions;

a third circuit configured to generate a compensation value of the input data based on the voltage drop compensating value and the color difference compensating value and to generate compensation data by performing an operation on the input data and the compensation value; and a fourth circuit configured to generate output data by dithering the compensation data.

11. The data compensator of claim 10, wherein the first circuit comprises:

a fifth circuit configured to divide the display panel into N voltage drop regions, where the N is an integer equal to or greater than 1, and to calculate a current ratio flowing through each of the voltage drop regions based on the input data provided to the pixels included in each of the voltage drop regions; and a sixth circuit configured to calculate the voltage drop compensation value based on a resistance coefficient of each of the voltage drop regions, the current ratio of each of the voltage drop regions, and a weighted value of each of the voltage drop regions.

12. The data compensator of claim 11, wherein the fifth circuit outputs the current ratio by calculating a ratio of the input data provided to all pixels in the display panel to the input data provided to the pixels included in each of the voltage drop regions.

13. The data compensator of claim 11, wherein the fifth circuit calculates the current ratio by summing a current ratio of a red sub-pixel included in each of the pixels, a current ratio of a green sub-pixel included in each of the pixels, and a current ratio of a blue sub-pixel included in each of the pixels.

14. The data compensator of claim 10, wherein the second circuit comprises:

a fifth circuit configured to divide the display panel into the color regions and to calculate the color difference compensation value of each of the color regions; and a memory device configured to store the color difference compensation value.

15. The data compensator of claim 14, the fifth circuit calculates the color difference compensation value based on the ratio of the predetermined reference color coordinate to the color coordinate of each of the color regions.

16. The data compensator of claim 10, wherein the third circuit comprises:

a fifth circuit configured to generate a compensation value of the input data based on the voltage drop compensating value and the color difference compensating value; and a sixth circuit configured to generate a compensation data by performing an operation the input data and the compensation value.

17. The data compensator of claim 16, wherein the fifth circuit generates the compensation value of the input data by multiplying the voltage drop compensation value with the color difference compensation value.

18. A display device comprising:

the display panel including the plurality of pixels;

the data compensator of claim 10;

a scan driver configured to provide a scan signal to the pixels;

a data driver configured to provide a data signal to the pixels; and a timing controller configured to generate control signals that control the display panel, the data compensator, the scan driver, and the data driver.

19. The data compensator of claim 18, wherein the data compensator is coupled to the timing controller or located within the timing controller.

* * * * *